US006890194B2

(12) United States Patent
Katsuma

(10) Patent No.: US 6,890,194 B2
(45) Date of Patent: May 10, 2005

(54) CONNECTOR HAVING AN OPERABLE MEMBER AND A METHOD OF ASSEMBLING SUCH A CONNECTOR

(75) Inventor: Takatoshi Katsuma, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/436,855

(22) Filed: May 13, 2003

(65) Prior Publication Data

US 2003/0216071 A1 Nov. 20, 2003

(30) Foreign Application Priority Data

May 14, 2002 (JP) ..... 2002-138202

(51) Int. Cl.[7] ..... H01R 13/62
(52) U.S. Cl. ..... 439/157; 439/347
(58) Field of Search ..... 439/152, 157, 439/310, 153, 372, 159, 352, 347

(56) References Cited

U.S. PATENT DOCUMENTS 5,871,363 A * 2/1999 Kimura ..... 439/157
5,876,226 A * 3/1999 Tsukakoshi et al. ..... 439/157
6,045,375 A * 4/2000 Aoki et al. ..... 439/157
6,083,017 A * 7/2000 Matsumura ..... 439/157
6,155,850 A * 12/2000 Martin et al. ..... 439/157
6,183,279 B1 * 2/2001 Murakami et al. ..... 439/157
6,244,880 B1 * 6/2001 Fukase et al. ..... 439/157

FOREIGN PATENT DOCUMENTS

JP 06-267610 9/1994

* cited by examiner

*Primary Examiner*—Hien Vu
(74) *Attorney, Agent, or Firm*—Gerald E. Hespos; Anthony J. Casella

(57) ABSTRACT

A connector has first and second housings (20, 10) that are connectable with one another. A lever (40) is mounted on the first housing (20) and has cam grooves (43) that engage cam pins (13) on the second housing (10). The housings (10, 20) are connected partly so that cam pins (13) fit into the cam grooves (43) to a specified position and so that mountable parts (12, 25; 28) begin engaging. The lever (40) then is operated, and a cam action is displayed as the cam pins (13) move in the cam grooves (43). As a result, the two housings (10, 20) are connected properly.

7 Claims, 7 Drawing Sheets

CONNECTOR HAVING AN OPERABLE MEMBER AND A METHOD OF ASSEMBLING SUCH A CONNECTOR

BACKGROUND OF THE INVENTION

1. Field of the Invention

The invention relates to a connector having an operable member or lever and to a method of assembling such a connector.

2. Description of the Related Art

Japanese Unexamined Patent Publication No. 6-267610 discloses a connector with first and second housings that are connectable with one another. Terminal fittings are accommodated in the housings and are connected with each other as the housings are connected. This connection of the terminal fittings creates a sliding resistance. The force required to complete the connection can be large, particularly for connectors with many terminal fittings. A lever often is used to assist connection when the connecting force is large. The lever is mounted on the first housing and is formed with a cam groove. A cam pin is provided on the second housing. The two housings are connected partly so that the cam pin fits into the cam groove to a specified initial position. The housings are constructed so that the terminal fittings have not yet begun to interfere with one another when the cam pin is at the specified initial position in the cam groove. The lever then is operated and displays a cam action as the cam pin moves in the cam groove. As a result, the housings are connected properly. An electrical connection test is conducted at a final stage of connection to detect whether the terminal fittings are accommodated properly in the housings and whether the lever has been operated.

A maximal operation force permitted during a connecting operation generally is specified as a standard value for connectors. However, the mountable parts of the above-described lever-type connector contact after the housings are mated further. Thus, the sliding resistance between the mountable parts is started after the operation of the lever. A peak operation force of the lever increases as indicated by a curve Y in FIG. 8, making a standard value (point S' in FIG. 8) larger.

The present invention was developed in view of the above problem and an object thereof is to reduce an operation force.

SUMMARY OF THE INVENTION

The invention is directed to a connector with first and second housings that are connectable with each other. An operable member, such as a lever, is mountable on the first housing and has at least one cam groove. At least one cam pin is provided on the second housing and is engageable with the cam groove to display a cam action. The cam action can be displayed by operating the operable member only after the housings are connected partly. At least one mountable part is provided in at least one of the housings, and creates sliding resistance as the housings are connected. The sliding resistance starts acting only when the housings are at or near the partly connected position. The operable member then is operated, and the two housings are connected properly by cam action displayed as the cam pin is moved in the cam groove.

The two housings are connected more deeply than in the prior art at the time of partial connection. The operable member then is operated at a stage where the sliding resistance has started or is close to starting. Therefore, an operating force to connect the housings partly is larger as compared to the prior art and the force for operating the operable member can be reduced by a corresponding amount. As a result, a maximum operation force required for the connector can be reduced.

The mountable parts preferably comprise terminal fittings in the housings for connection with each other.

The connection of the terminal fittings is set to start or be close to starting when the housings reach the partly connected state.

The mountable part may comprise a seal mounted in one of the housings for close contacting the other housing.

The contact of the seal and the other housing is set to start or to be close to starting when the housings are partly connected.

The cam groove preferably has a substantially straight portion aligned substantially along a connecting direction of the housings and a cam portion aligned oblique to both the connecting direction and a displacing direction of the movable member. The cam pin preferably is in the cam portion of the cam groove when the housings reach the partly connected state.

The cam pin is already in the cam portion of the cam groove when the housings are connected partly to start the contact of the mountable part and its mating partner.

The length of the section of the connection stroke along the straight portion, as measured parallel to the connecting direction, is longer than the length of the section of the connection stroke along the cam portion, as measured parallel to the connecting direction.

A detector preferably is provided for detecting whether the operable member is in a connecting position where the housings are connected properly.

The invention also relates to a method of connecting a connector. The method comprises connecting first and second housings of a connector to a partly connected state. The method then comprises operating an operable member for displaying the cam action to connect the housings properly only after the housings are in the partly connected state.

These and other objects, features and advantages of the present invention will become more apparent upon reading of the following detailed description of preferred embodiments- and accompanying drawings. It should be understood that even though embodiments are separately described, single features thereof may be combined to additional embodiments.

DETAILED DESCRIPTION OF THE PREFERRED EMBODIMENTS

A lever-type connector according to the invention is illustrated in FIGS. 1 to 8. The lever-type connector has male and female housings 10 and 20 that are connectable with each other along a connecting direction CD and a lever 40 that is mountable on the female housing 20. Ends of the housings 10, 20 that are connected are referred to as the front ends in the following description.

Figure 1:
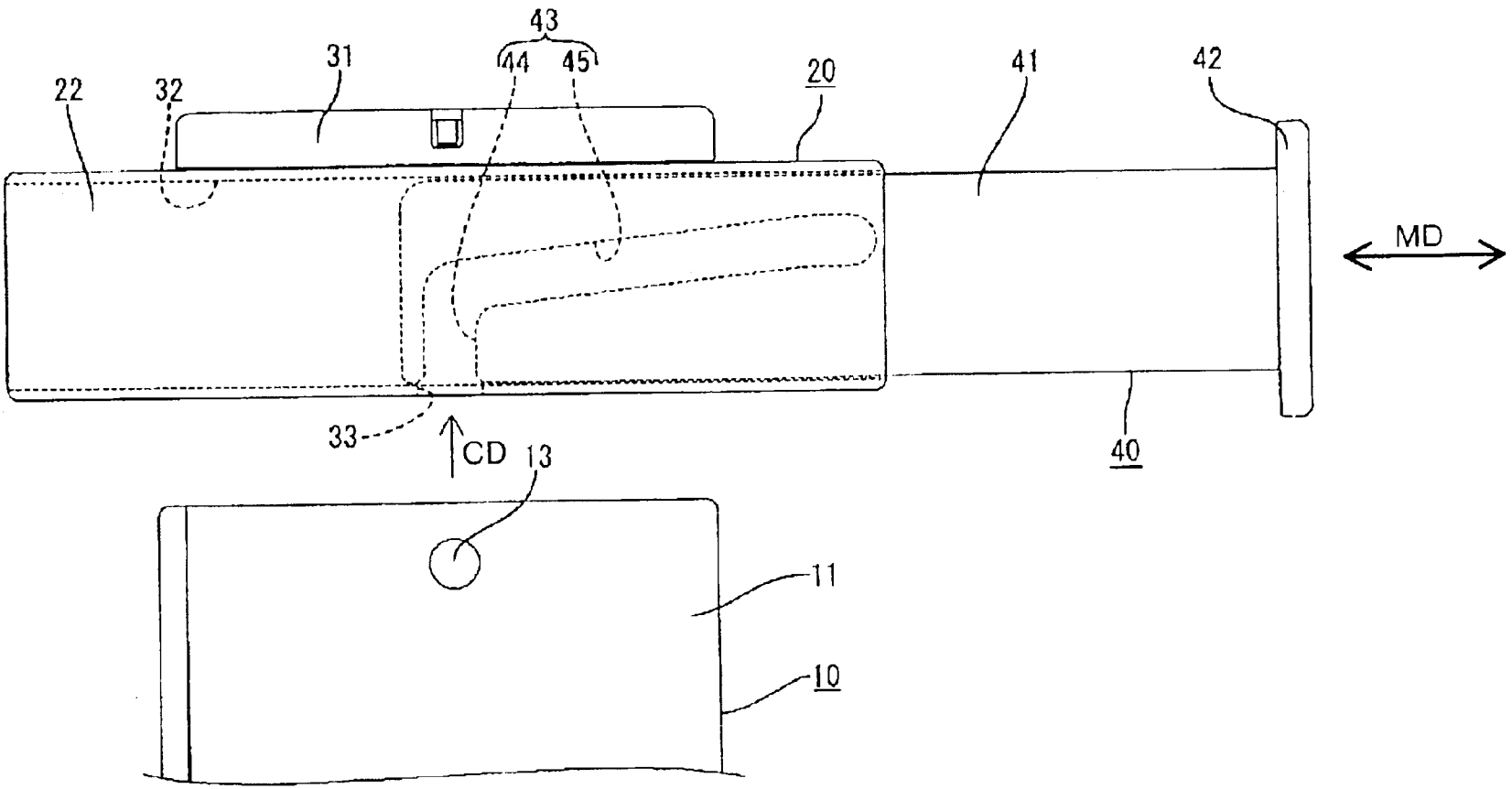
FIG. 1 is an exploded plan view of a lever-type connector according to one embodiment of the present invention.
Figure 3:
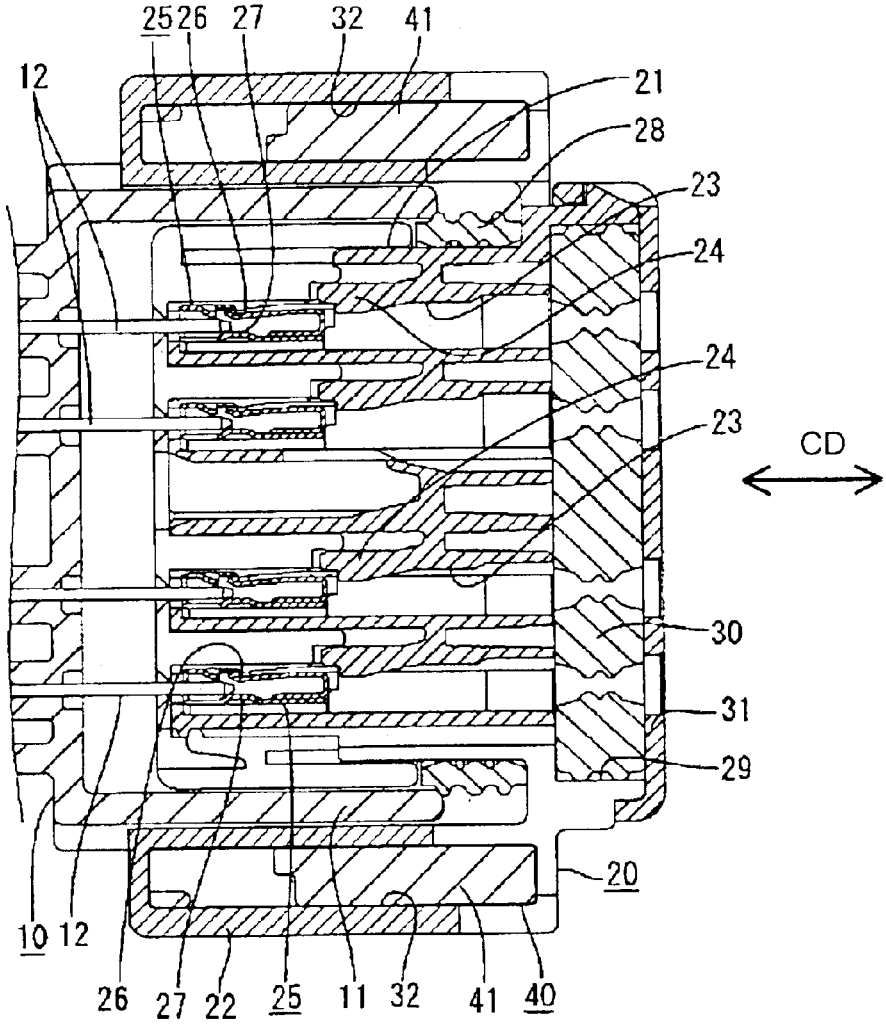
FIG. 3 is a vertical sectional view of FIG. 2.
Figure 4:
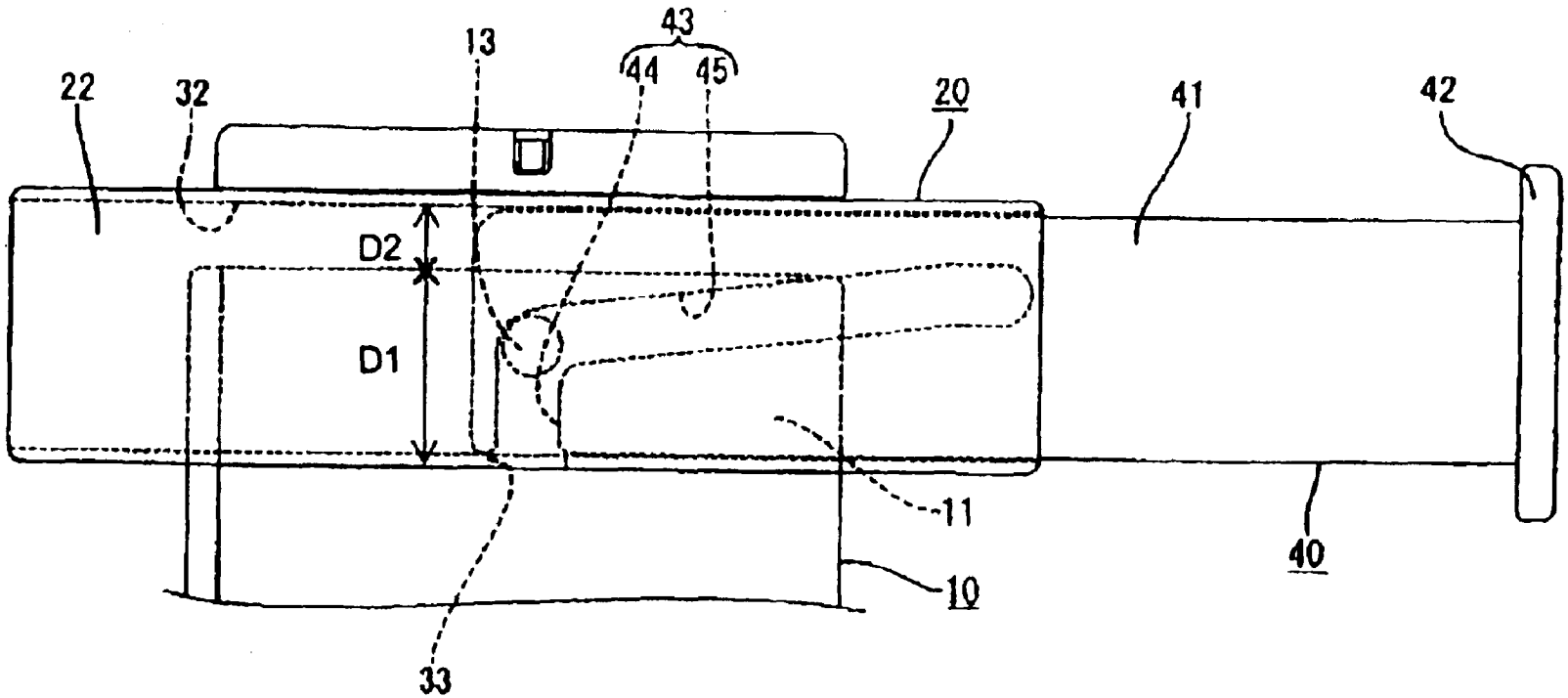
FIG. 4 is a plan view showing a partly connected state of the two housings.

The male housing 10 is formed e.g. of a synthetic resin material and, as shown in FIGS. 1 and 3, has a substantially rectangular tubular receptacle 11 that opens forward. Tab-shaped male terminal fittings 12 project forward from a back wall of the receptacle 11. Substantially cylindrical cam pins 13 project from side surfaces of the receptacle 11 and are aligned substantially normal to the connecting direction CD of the housings 10, 20.

The female housing 20 is formed e.g. of a synthetic resin material and has a terminal accommodating portion 21 for accommodating female terminal fittings 25. A substantially rectangular outer tube 22 surrounds the outer side of the terminal accommodating portion 21 and opens forward toward the male housing 10. The receptacle 11 of the male housing 10 is fittable between the terminal accommodating portion 21 and the outer tube 22 from the front along the connection direction CD.

Cavities 23 are formed in the terminal accommodating portion 24 and are arranged in four stages substantially one over another, as shown in FIG. 3. The female terminal fittings 25 are insertable into the cavities 23 from behind. A lock 24 projects at the ceiling surface of each cavity 23 and is resiliently engageable with the corresponding female terminal fitting 25. Each female terminal fitting 25 has a main body in the form of a forwardly open box. The male terminal fitting 25 has a wire connecting portion that is connectable with a wire. A resilient contact piece 26 is provided inside the main body and contacts the male terminal fitting 12 entering from the front. A receiving portion 27 is embossed to project in from a wall of the main body that faces the resilient contact piece 26. The receiving portion 27 cooperates with the resilient contact piece 26 for tightly holding the male terminal fitting 12. A seal ring 28 is mounted on the outer peripheral surface of the terminal accommodating portion 21 and is squeezed by the receptacle 11 for sealing a space between the two housings 10, 20. A rubber plug accommodating recess 29 is provided at the rear end of the terminal accommodating portion 21 for accommodating a one-piece rubber plug 30. The rubber plug 30 has wire insertion holes that corresponding to the respective cavities 23. Portions of the rubber plug 30 surrounding the wire insertion holes closely contact the outer circumferential surfaces of the respective wires for sealing inner spaces of the respective cavities 23. A pressing member 31 is mountable on the outer side of the rubber plug accommodating recess 29 for holding the one-piece rubber plug 30.

The outer tube 22 is coupled to the outer peripheral surface of the rear portion of the terminal accommodating portion 21 and is slightly larger than the receptacle 11 of the male housing 10. Both the upper and lower parts of the outer tube 22 shown in FIG. 3 are substantially tube-shaped and open toward opposite sides. Openings of the tube 22 serve as lever accommodating chambers 32 for accommodating the lever 40 sideways. A front wall and an inner wall of each lever-accommodating chamber 32 are cut away to form a groove 33 (only a part thereof shown) for permitting entry of the cam pin 13 projecting on the receptacle 11 into the lever accommodating chamber 32.

The lever 40 is formed e.g. of a synthetic resin and has two arms 41 that face each other and a coupling portion 42 that couples the ends of the arms 41. Thus, the lever 40 has a substantially U-shape. The lever 40 is mounted into the female housing 20 so that the arms 41 are inserted sideways into the lever accommodating chambers 32. The lever 40 is movable along a moving direction MD between an initial position shown in FIG. 1 and a connection position shown in FIG. 6. An unillustrated holding means is provided for holding the lever 40 in the initial position and the connection position. The moving direction MD is substantially normal to the connecting direction CD of the housings 10, 20. A front part of each arm 41 of the lever 40 is in the lever-accommodating chamber 32 when the lever is at the initial position and a remaining part thereof projects sideways. The arms 41 are substantially entirely in the lever accommodating chambers 32 when the lever 40 is at the connection position.

Cam grooves 43 are formed the arms 41 and are dimensioned to receive the cam pins 13 of the male housing 10. Each cam groove 43 has a substantially straight portion 44 that opens forward and substantially straight along the connecting direction CD. A cam portion 45 is formed continuously behind the straight portion 44 and communicates with the straight portion 44. The cam portion 45 extends back from the male housing 10 oblique to both the connecting direction CD and moving directions MD of the lever 40. Each straight portion 44 is at an end of the corresponding arm 41 opposite the coupling portion 42 and aligns substantially with the groove 33 to permit entry of the cam pin 13 from the front when the lever 40 is at the initial position. The housings 10, 20 can be connected to a partial connection position, where the cam pins 13 reach the rear ends of the straight portions 44 and/or the front ends of the cam portions 45. The receptacle 11 contacts the seal ring 28 and starts to deform the seal ring 28 resiliently at this partial connection position. Additionally, the male terminal fittings 12 are fit between the resilient contact pieces 26 and the receiving portions 27 of the female terminal fittings 25 and deform the resilient contact pieces 26. As a result, the corresponding pairs of terminal fittings 12, 25 start being connected with each other (see FIG. 5). Connection resistance becomes active at or near this point of the connection of the connector housings 10, 20 due to the engagement of the seal ring 28 and the receptacle 11 and the engagement of the terminal fittings 12, 15. The terminal fittings 12, 15 preferably engage one another by at least 1 mm at this stage of the connection process.

A dimension of the cam portion 45 along the widthwise direction of the female housing 20 is about half the corresponding dimension of the arm 41, and a dimension of the cam portion 45 in forward and backward directions is less than the corresponding dimension of the straight portion 44. Accordingly, a connection stroke along the connecting direction CD during which the cam pin 13 moves along the straight portion 44 is longer than a connection stroke along the connecting direction CD during which the cam pin 13 moves along the cam portion 45. A cam action to connect or separate the housings 10, 20 is displayed by displacing the lever 40 widthwise along the moving direction MD while engaging the cam pins 13 with the groove edges of the cam portions 45.

Figure 2:
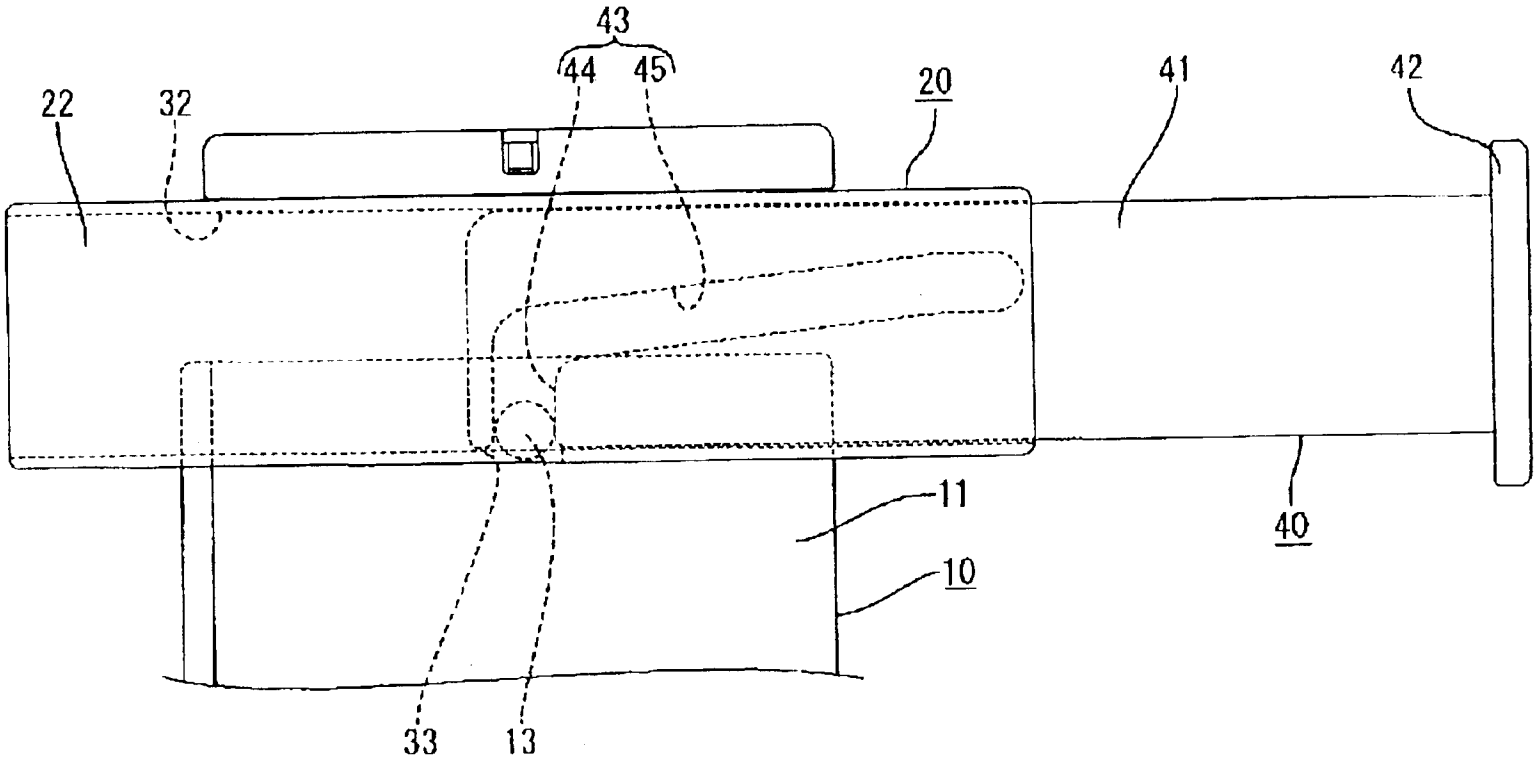
FIG. 2 is a plan view showing an intermediate stage of partly connecting two housings.
Figure 5:
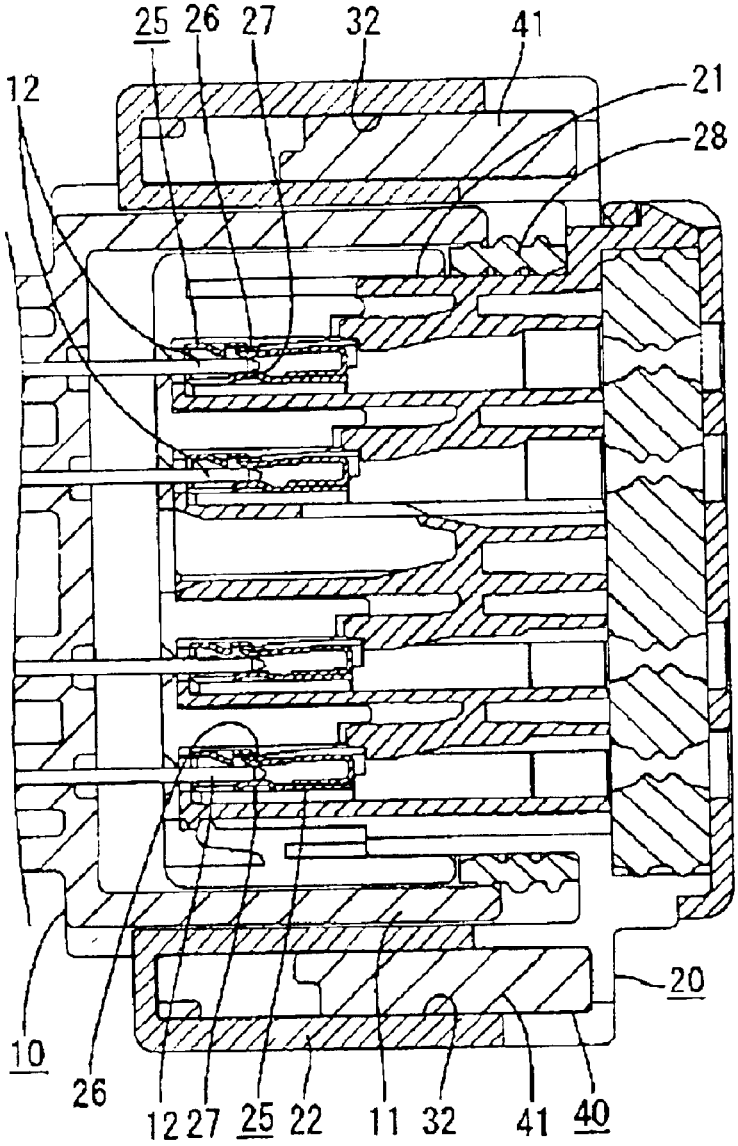
FIG. 5 is a vertical sectional view of FIG. 4.

The two housings 10, 20 are connected by first fitting the receptacle 11 of the male housing 10 manually between the terminal accommodating portion 21 and the outer tube 22 of the female housing 20. In this process, as shown in FIGS. 2 and 3, the cam pins 13 pass the grooves 33 and enter the straight portions 44 of the cam grooves 43. Additionally, the receptacle 11 contacts the seal ring 28 and creates a sliding resistance against the seal ring 28. The two housings 10, 20 are in the partly connected state shown in FIG. 4, when the cam pins 13 reach the rear ends of the straight portions 44. At this time or close to this time, the male terminal fittings 12 are held tightly between the resilient contact pieces 26 and the receiving portions 27 of the female terminal fittings 25 and resiliently deform the resilient contact pieces 26, as shown in FIG. 5. The overlap between the male and female terminal fittings along the connection direction exceeds 1 mm. Thus, the corresponding pairs of the terminal fittings 12, 25 start to be connected, and a sliding resistance is created between the terminal fittings 12, 25.

Figure 6:
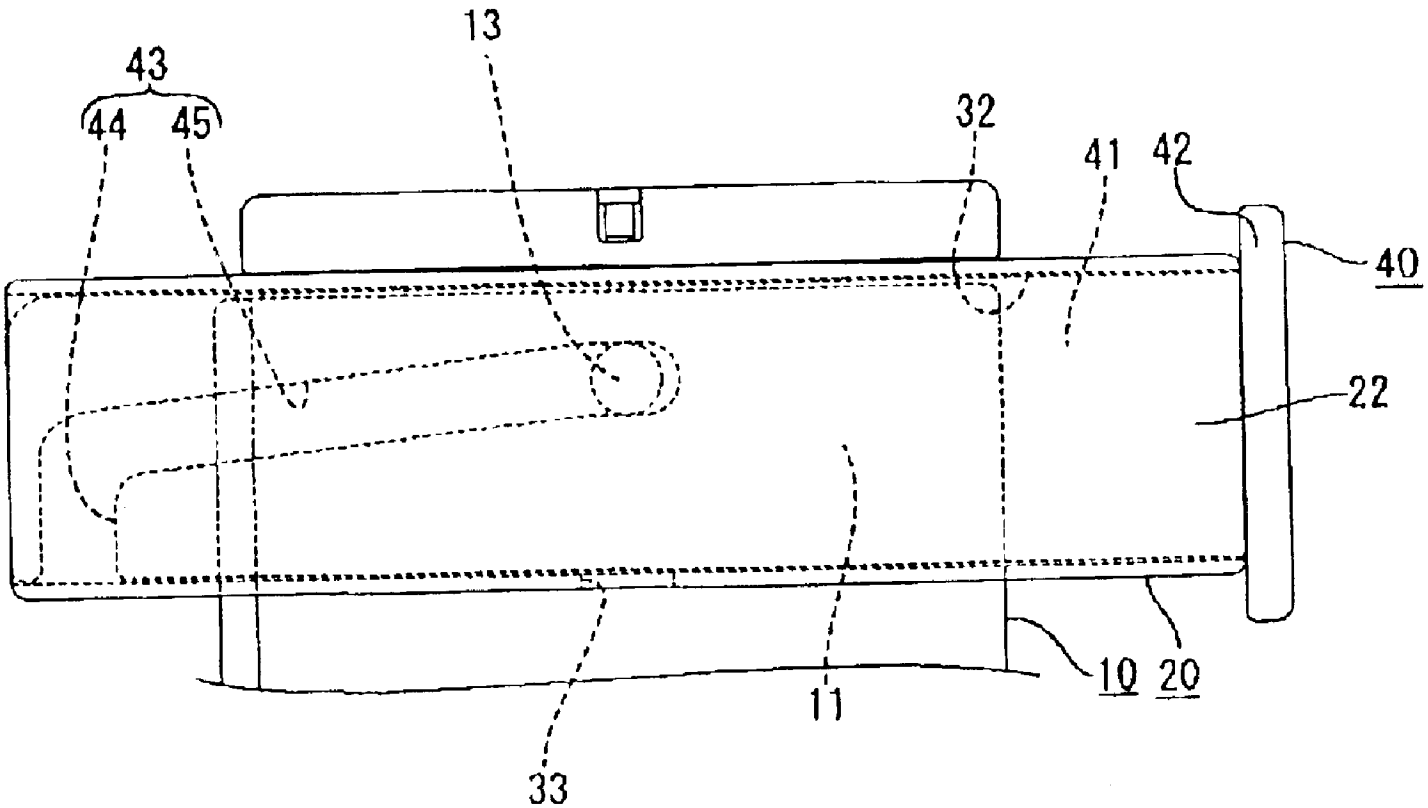
FIG. 6 is a plan view showing a state where a lever reaches a connection position to properly connect the two housings.
Figure 7:
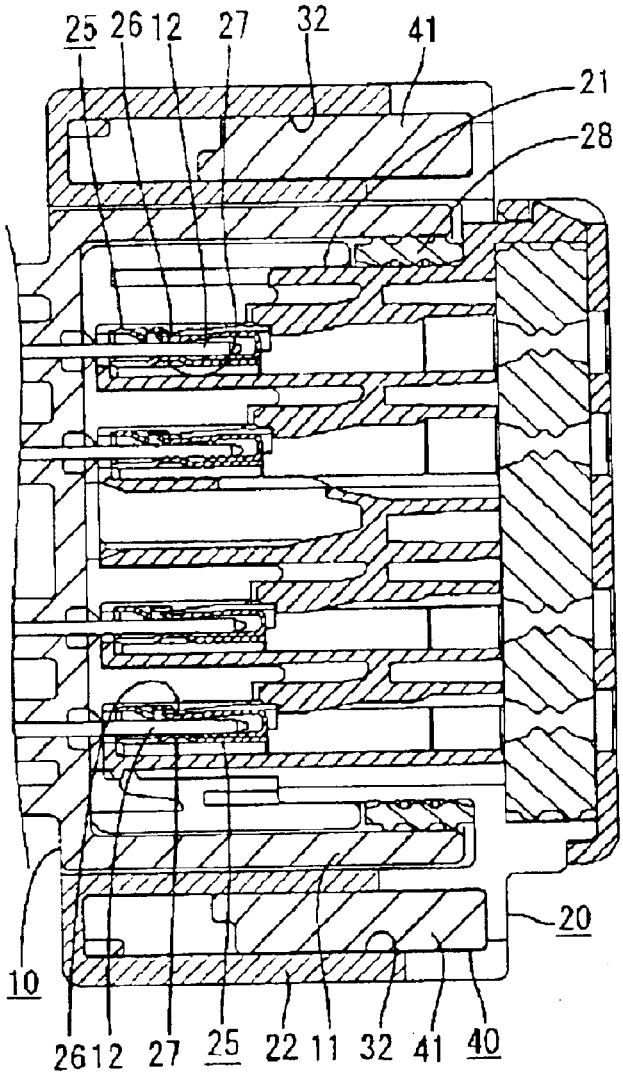
FIG. 7 is a vertical sectional view of FIG. 6.

The coupling portion 42 then is pushed and the lever 40 is displaced along the moving direction MD from the initial position to the connection position. As a result, the front edges of the cam portions 45 engage the cam pins 13 and move the cam pins 13 from the front ends to the rear ends of the cam portions 45. In this process, the male terminal fittings 12 are inserted deeper into the female terminal fittings 25 and are held in sliding contact with the resilient contact pieces 26 and the receiving portions 27. The two housings 10, 20 are connected properly, as shown in FIG. 6, when the lever 40 is pushed toward the connection position so that the cam pins 13 reach the rear ends of the cam portions 45. At this time, as shown in FIG. 7, the male terminal fittings 12 are inserted into the female terminal fittings 25 to a specified depth. Thus the two terminal fittings 12, 25 are connected properly with each other. Further, the space between the two housings 10, 20 is sealed by squeezing the seal ring 28 between the inner surface of the receptacle 11 and the outer surface of the terminal accommodating portion 21.

A check may be conducted to determine whether the two housings 10, 20 are connected properly. This check is conducted using, for example, an unillustrated detector. The detector interferes with the lever 40 when the lever 40 is stopped before reaching the connection position. The detector may be free from interference with the lever 40 when the lever 40 reaches the connection position. Further, an optical and/or electromagnetic sensor may be used as an alternate or additional checking method. Thus, it is possible to detect whether the lever 40 has been operated even if the connection of the terminal fittings 12, 25 starts when the two housings 10, 20 are connected partly. Thereafter, an electrical connection test can be conducted to detect whether each terminal fitting 12, 25 is accommodated properly in each housing 10, 20.

The two housings 10, 20 may have to be detached from each other for maintenance or for some other reason. In such a case, the lever 40 is moved from the connection position to the initial position. Thus, the cam pins 13 are pushed out by the rear edges of the cam portions 45 and are moved toward the front ends in the cam portions 45. The cam action displayed in this process separates the two housings 10, 20 from each other.

Figure 8:
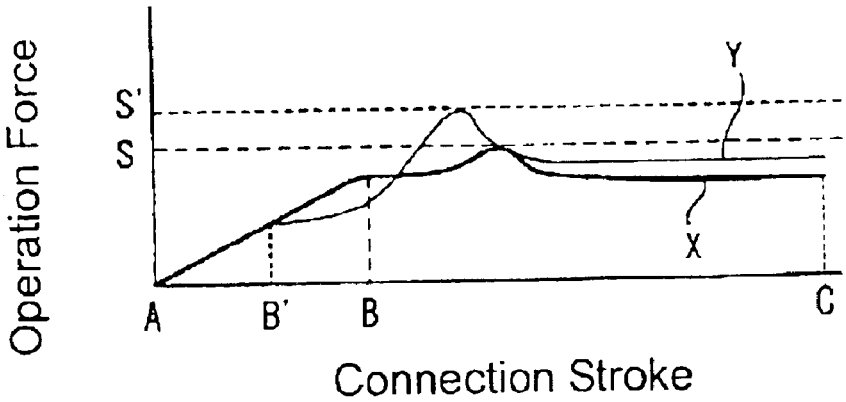
FIG. 8 is a graph showing a relationship between an operation force and a connection stroke of the connector housings.

A relationship between the connection stroke of the two connector housings 10, 20 and the operation force needed to connect the connector housings 10, 20 is described in detail with reference to a graph of FIG. 8. The curve X in FIG. 8 represents this embodiment. Point A on horizontal axis corresponds to an intermediate stage of the partial connection (FIGS. 2 and 3), point B corresponds to a partly connected state (FIGS. 4 and 5), point C corresponds to a properly connected state (FIGS. 6 and 7). The curve Y represents the prior art lever-type connector as a comparison.

The operation force gradually increases in the process of partly connecting the two housings 10, 20 due to sliding resistance that acts while the receptacle 11 squeezes the seal ring 28 and/or the male terminal fittings 12 deform the resilient contact pieces 26 of the female terminal fittings 25. The cam pins 13 still are in the straight portion 44 until the partly connected state is reached (point B). Thus, the lever 40 cannot be operated until the partly connected state is reached and no cam action can be displayed. The cam pins 13 reach the beginning of the cam portion 45 when the connector housings 10, 20 reach the partly connected state (point B). Thus, the lever 40 can be operated to display the cam action of the cam pins 43 and the cam portion 45. An even larger operation force is required to connect the two housings 10, 20 properly (moving from point B to point C) due to sliding resistance between the receptacle 11 and the seal ring 28 and/or the sliding contact between the terminal fittings 12, 25. However, the two housings 10, 20 can be connected properly by a smaller operation force than the one at a peak due to inertia after a certain operation force is exerted.

The seal ring 28 contacts the receptacle 11 and the terminal fittings 12, 25 start connecting when the two housings 10, 20 are connected partly. Thus, sliding resistance starts acting. In other words, the lever 40 is operated after the two housings 10, 20 are connected more deeply than in the prior art (point B' in FIG. 8). Thus, as compared to the prior art, the operation force of the lever 40 of the subject invention is made smaller by as much as a force necessary to partly connect the two housings 10, 20. A difference between the operation force at the time of the partial connection and the operation force of the lever 40 can be reduced to average the two forces. Accordingly, a standard value (point S on vertical axis in FIG. 8) of the operation force of this embodiment can be made smaller than the standard value (point S' in FIG. 8) of the prior art.

The housings 10, 20 of this embodiment are connected more deeply than the prior art at the time of the partial connection. Thus, the connection stroke by the lever 40, i.e. the dimension of the cam portions 45 in forward and backward directions, is made shorter. When the operation range of the lever 40 is same as in the prior art, the cam portions 45 of this embodiment are formed such that the groove edges of the cam portions 45 engaged with the cam pins 13 has a smaller angle of the inclination to the widthwise direction than in the prior art. In this way, the operation force of the lever 40 in this embodiment is smaller than in the prior art, which contributes to a reduction in the standard value of the operation force.

The present invention is not limited to the above described and illustrated embodiment. For example, following embodiments are also embraced by the technical scope of the present invention as defined by the claims. Beside the following embodiments, various changes can be made without departing from the scope and spirit of the present invention as defined by the claims.

In the foregoing embodiment, when the two housings are partly connected, the receptacle contacts the seal ring and the terminal fittings start being connected with each other. However, the receptacle may contact the seal before the terminal fittings contact each other, or the terminal fittings may contact each other before the receptacle contacts the seal ring.

The straight portions of the cam grooves are longer than the cam portions in the foregoing embodiment. However, the straight portions may be shortened and the positions of the cam pins may be displaced more backward from the male housing. At this time, the cam portions may be displaced forward in parallel so that the sliding resistance of the seal ring and/or the terminal fitting(s) starts acting when the housings are partly connected.

Although the lever is in the female housing in the foregoing embodiment, it may be mounted in the male housing and the cam pins may be on the female housing.

The lever-type connector has a watertight function in the foregoing embodiment. However, the invention also is applicable to nonwatertight connectors where no seal ring and/or no rubber plugs are present.

The lever-type connector has the sliding-type lever as the operable member in the foregoing embodiment. However, the invention also is applicable, for example, to a lever-type connector with a rotating-type lever rotatably supported on a housing. In such a case, a cam groove in the lever is has a straight portion and a cam portion curved such that the rear end thereof gradually comes closer to an axis of rotation of the lever.

What is claimed is:

1. A connector, comprising:

first and second housings connectable with each other;

an operable member mountable on the first housing and provided with at least one cam groove, the cam groove having a straight portion aligned along a connecting direction of the housings and a cam portion extending oblique to both the connecting direction and a displacing direction of the operable member, the straight portion and the cam portion each having an entry and an end, the end of the straight portion being adjacent the entry of the cam portion; and at least one cam pin on the second housing and engageable with the corresponding cam groove for displaying a cam action, wherein:

the cam action is displayed by operating the operable member only after the housings are partly connected with the cam pin being in the cam portion of the cam groove; and at least first and second terminal fittings in the respective first and second housings, the first and second terminal fittings being connectable with each other and creating sliding resistance as the housings are connected, the first and second terminal fittings being configured and disposed such that the sliding resistance starts acting before the cam pin reaches the cam portion of the cam groove for reducing a peak operation force on the operable member; and a seal mounted to one of the first and second housings, the seal being disposed and configured for closely contact the other of the first and second housings before the cam pin reaches the cam portion of the cam groove.

2. The connector of claim 1, wherein a connection stroke along the connecting direction corresponding to which the cam pin moves along the straight portion is at least twice as long as a connection stroke along the connecting direction corresponding to which the cam pin moves along the cam portion.

3. A connector, comprising:

first and second housings configured for movement relative to one another along a connecting direction from an unconnected state to a partly connected state and then to a properly connected state;

at least first and second terminal fittings in the respective first and second housings and being connectable with each other, the first and second terminal fittings being disposed and configured for creating a sliding resistance beginning when the housings are in the partly connected state;

a seal mounted to one of the first and second housings, the seal being disposed and configured for closely contact the other of the first and second housings and creating an additional sliding resistance beginning when the housing are in the partly connected state;

at least one cam pin on the second housing;

an operable member mountable on the first housing and movable along a moving directions, the operable member having at least one cam groove configured and disposed for receiving the cam pin as the housings move along the connecting direction beyond the unconnected state, the cam groove having a straight portion aligned substantially along the connection direction and a cam portion aligned oblique to both the connecting direction and the moving direction, the cam groove being configured such that the cam pin substantially enters the cam portion after the housings reach the partly connected state for reducing a peak operation force on the operable member.

4. The connector of claim 3, wherein the housings define a connection stroke having a length along the connection direction extending from the unconnected state to the properly connected state, the straight portion of the cam groove defining a length along the connection direction more than half the length of the connection stroke.

5. A connector, comprising:

first and second housings configured for movement relative to one another along a connecting direction from an unconnected state to a partly connected state and then to a properly connected state;

at least one mountable part in at least one of the housings and configured for creating a sliding resistance beginning when the housings are in the partly connected state, the mountable part comprising a seal mounted on one of the housings and configured for closely contacting the other of the housings;

at least one cam pin on the second housing;

an operable member mountable on the first housing and movable along a moving direction, the operable member having at least one cam groove, the cam groove having a straight portion aligned substantially along the connection direction and accommodating the cam pin as the housings move from the unconnected state to the partly connected state, the cam groove further having a cam portion extending obliquely from the straight portion and accommodating the cam pin as the housings move from the partly connected state to the properly connected state, movement of the housings along the connecting direction from the unconnected state to the partly connected state being at least twice as long as the movement of the housing along the connecting direction from the partly connected state to the properly connected state, whereby the sliding resistance that occurs when the housings are in the partly connected state reduces a peak operation force on the operable member.

6. The connector of claim 5, wherein the mountable part comprises at least first and second terminal fittings in the respective first and second housings and connectable with each other.

7. The connector of claim 6, wherein the mountable part further comprises a seal mounted in the first housings and configured for closely contacting the second housings.

* * * * *